United States Patent [19]

Dowdy

[11] 4,299,123

[45] Nov. 10, 1981

[54] SONIC GAS DETECTOR FOR ROTARY DRILLING SYSTEM

[76] Inventor: Felix A. Dowdy, 2097 B 83rd Ct., Tulsa, Okla. 74136

[21] Appl. No.: 84,821

[22] Filed: Oct. 15, 1979

[51] Int. Cl.[3] ..... E21B 47/10

[52] U.S. Cl. ..... 73/155

[58] Field of Search ..... 73/155, 151; 175/40, 175/50

[56] References Cited

U.S. PATENT DOCUMENTS 3,477,526 11/1969 Jones et al. ..... 73/151 X 3,841,152 10/1974 Guest ..... 73/151

*Primary Examiner*—Jerry W. Myracle

*Attorney, Agent, or Firm*—Head & Johnson

[57] ABSTRACT

In a rotary drilling system using a drill string, and a mud circulating system, in which mud is passed from a pump to a standpipe and drill string, to and through the bit, into the annulus of the borehole, and to the surface, a method of detecting the entry of gas into the mud in the annulus at or near the bit comprising creating and measuring in the high pressure mud conduit a selected type of pressure disturbance, inserting a pressure sensor in the casing near the wellhead to detect the presence of this pressure disturbance after traveling down the mud column in the drill pipe and up through the annulus, and recording these two pressures. Comparison is made of the two pressure traces, from which can be determined the time lag between the initiation, at one sensor, and the reception of the characteristic pressure variations at the other sensor, and also the attenuation of the characteristic pressure variations due to the travel of the elastic waves through the mud column.

10 Claims, 2 Drawing Figures

SONIC GAS DETECTOR FOR ROTARY DRILLING SYSTEM

BACKGROUND OF THE INVENTION

1. Field of the Invention

This invention lies in the field of rotary drilling of oil and gas wells. More particularly, it concerns method and apparatus for determining if, and when, gas enters the drilling well at a point near the bottom of the well, from a formation into which the well is being drilled, or through which it has been drilled.

Still more particularly, it concerns apparatus and method for detecting the presence of gas entering the well at the time the gas-containing formation is penetrated, and without the necessity of waiting until the first sample of gas flowing into the mud column reaches the surface.

2. Description of the Prior Art

In the prior art there has been no way of detecting just when a gas-containing geologic formation is penetrated by the bit, and/or gas under a pressure greater than the mud pressure in the well can flow into the mud column, and up the annulus of the well to the surface. The only method of detection was to wait for a period of time sufficient for the flow of mud from the bottom of the well to the surface, and to detect the presence of gas in the outflow of mud from the casing. By the method of this invention it should be possible to detect almost immediately the injection of gas from the formation into the well.

SUMMARY OF THE INVENTION

It is a primary object of this invention to provide a method of and apparatus for detecting the presence of gas in the mud in the annulus of a well being drilled by a rotary drilling apparatus.

Still more particularly it is an object of this invention to map the passage and progress of the gas into the mud in the annulus, as the upwardly flowing mud carries the gas from the bottom of the well to the surface.

These and other objects are realized, and the limitations of the prior art are overcome in this invention by using the transmission characteristics of elastic waves in the liquid mud column, to detect the presence of gas mixed in the mud.

These and other objects are realized and the limitations of the prior art are overcome in this invention by installing in the mud system a first pressure gauge or pressure sensor in the mud standpipe, which will record, as a first trace, the pressure variations in the mud flowing into the top of the drill pipe, and also installing a second pressure sensor which will record as a second trace, the pressure at a second point in the mud system; namely, in the casing near the wellhead.

Variations in pressure are created in the mud standpipe. Some of these may be due, for example, to naturally occurring situations, such as when the mud pumps are first started up, the pressure in the mud standpipe will build up in a characteristic pattern of pressure. Also, because of the discrete number of pistons and cylinders in the pump there will be pulsations in the magnitude of pressure, which will be characteristic of that particular system. These pressure variations at the input to the drill string will serve as a source of elastic waves, of a certain frequency, which will travel down the mud inside of the drill pipe through the bit and up through the mud in the annulus, to the surface, to the second pressure detector attached to the casing at the surface.

In the prior art it has been known that the presence of gas bubbles in a viscous liquid such as drilling mud can be detected by measuring the velocity of propagation of elastic waves through the mud. Such applications have been limited solely to samples of mud available at the surface of the earth. Thus, a conduit or channel which carries a stream of mud may have a pressure transducer at one wall and a pressure receiver or sensor at the other wall. The velocity of propagation of elastic waves created by the source can be measured as they traverse the channel of mud.

There is also the more conventional method of creating a slight vacuum above the channel through which the mud is flowing and drawing off any gas that may evolve from the surface of the mud, and examining that gas with an appropriate detection instrument to determine whether it is natural gas, or air, or some other gas.

The difficulty with these prior art systems is that there is no way of detecting this gas prior to the transport of the mud containing gas bubbles, from the point of entry into the annulus, which is normally close to the bottom of the well, until this mud has traveled up to the surface.

It is well known also that the velocity of propagation of elastic waves in a liquid is substantially constant, unless there are small gas bubbles distributed through the liquid, which provide a measure of compressibility. Since the velocity of propagation of the elastic waves is a function of this compressibility of the medium, the velocity will be reduced as the proportion of the volume taken up by the gas increases from zero to some maximum value. The higher the percentage of free gas in the liquid, in the form of small bubbles or microbubbles, the lower the velocity of propagation of the elastic waves. For comparison, the velocity of propagation of elastic waves in air, at atmospheric pressure, is approximately one-fifth of what it would be in pure water.

The time of travel through a column of liquid of these elastic waves depends not only on the velocity of propagation of the elastic waves in the liquid, but also the velocity of the liquid itself. As the elastic waves travel through the liquid any progression or movement of the liquid along the conduit will appear to increase or decrease the velocity of transmission, depending on whether the directions of liquid flow and propagation are the same or opposite. However, if the pump rate and flow rate of mud through the system is substantially the same, then the time of travel of a pressure disturbance at the input to the drill string down to the bottom and up through the annulus to the surface again will be constant so long as the depths of the hole are the same, or the lengths of drill pipe are the same. If between two successive measurements the drilling has proceeded and the drill pipe has been increased in length by a selected dimension, then appropriate recognition of the increased length of path must be taken into account, and so on, as would be well known in the art.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
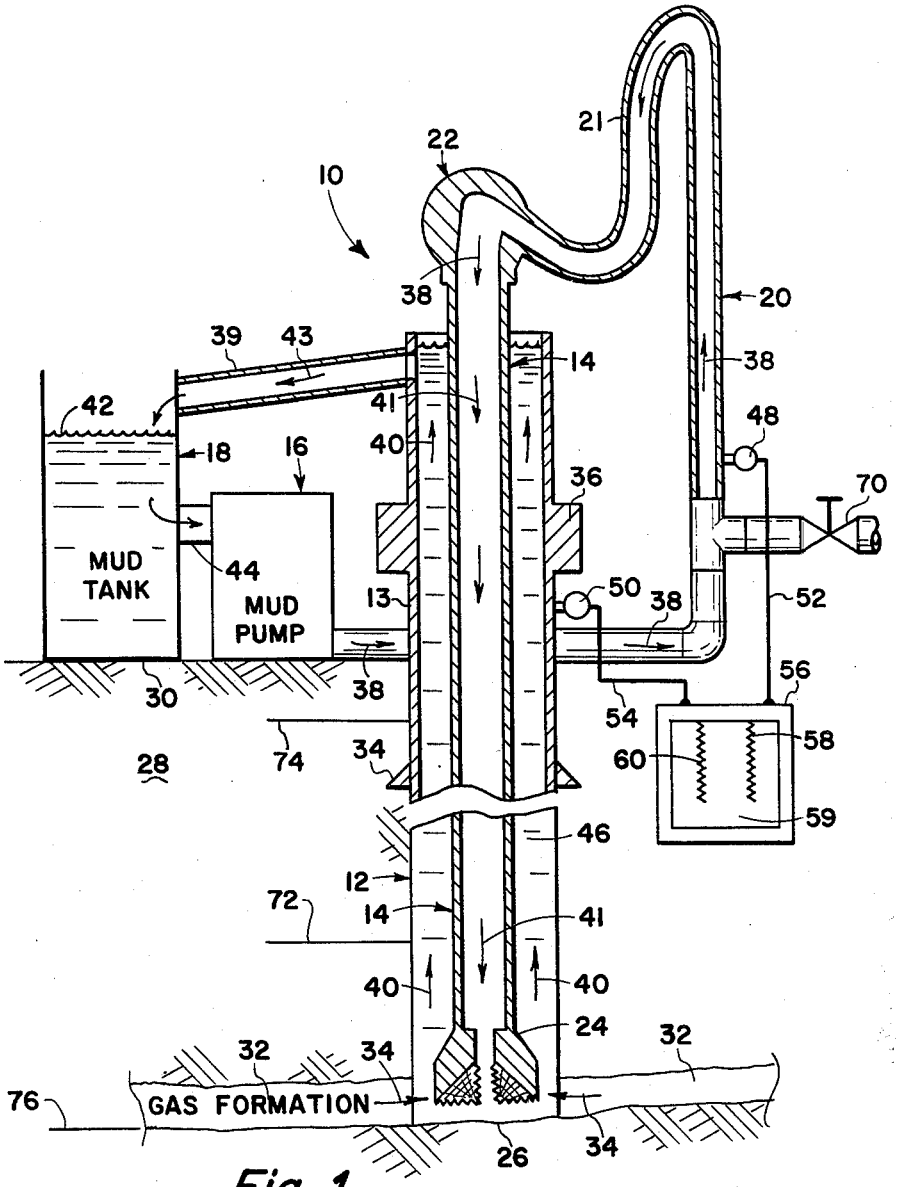
FIG. 1 represents in schematic form, and in partial cross-section, one embodiment of the invention.

Referring now to the drawings, there is shown in FIG. 1, in cross-section, a borehole indicated generally by the numeral 12, in the earth 28, to a selected depth below the surface 30 of the earth. Casing will normally be set from the surface to a selected depth, to a casing seat 34, while drilling is being carried on to some depth below the casing seat, in an open hole. At some depth 76 there is a geologic formation containing gas in the pores of the rock. From the portion of the formation within the confines of the borehole diameter, a certain amount of gas will be released into the mud. Also, if the bottom hole pressure of the mud is not greater than the pressure of the gas in the formation 32, there will be some flow of gas from the formation 32 through the borehole wall, into the annular space 46 between the drill stem and the borehole wall and casing.

In the casing is a drill string 14 which comprises a series of joints of drill pipe which are supported in the rotary table (not shown) and are terminated at the bottom end, by an appropriate bit 24 for drilling into the rock. The drill steam, or drill pipe, indicated generally by the numeral 14, has a fixture called a swivel 22 at its top end, so that drilling mud from a mud standpipe 20 can flow through an appropriate flexible pipe 21, to the swivel. While the pipe turns, and the swivel remains stationary, mud flows from the standpipe through the flexible section 21, through the swivel 22, and down the drill pipe 14, and through the bit 24 into the annular space 46 between the drill pipe 14 and the borehole wall 12, or the casing 13.

As the drilling mud flows down through the drill pipe, as shown by arrows 41, and up the annular 46 in accordance with arrows 40, it overflows into a conduit 39 in accordance with arrow 43, and empties into a mud pit, or mud tank, 18, having a mud surface 42. A mud pump indicated schematically by the rectangle 16 is of conventional construction. It withdraws mud from the mud tank 18 through conduit 44, to increase its pressure, and discharge it in accordance with arrow 38 through the mud standpipe 20 at a selected pressure. It then flows down through the drill pipe 14, and so forth. While the mud flows at the same mass flow rate through these three sections of conduits (they have been numbered 38, 41, and 40), the actual velocity of flow will be a function of conduit size, and so on. The flow velocity of the mud through the drill pipe will typically be higher in the drill pipe than in the annulus.

For the same length of drill pipe in the hole, and the same pump speed, the mud flow velocity in the three segments of the circuit; namely, the standpipe 20, the drill stem 14, and the annulus 46, will be relatively constant, and so the total time delay from the point of entry of the mud into the drill pipe, for example, to the time it flows down the conduit 39, will be constant.

As the drilling proceeds and the additional drill pipe is added to the drill string, there will be additional delay in the overall flow, because of the length of path increase in the drill stem and in the annular space. This can easily be taken into account by one skilled in the art.

There is installed in the standpipe a pressure sensor 48. In the casing 32 above the surface and near the wellhead 36, a second pressure gauge, or pressure sensor, 50 is installed. The outputs of each of these two pressure gauges 48 and 50 are recorded as two separate traces 58 and 60, respectively, on a record sheet 59 of a pen recorder, for example, 56. The signals from the pressure sensors are transmitted by appropriate electrical circuits 52 and 54 respectively.

From FIG. 1 it will be clear that there is a substantially continuous and enclosed circuit for flow of drilling mud from the pressure sensor 48, through the standpipe 20, through the flexible section 21, swivel 22, drillstem 14, and the annulus 46, to the surface. All mud that flows past the sensor 48 will eventually flow past the sensor 50.

If there is a pressure variation of some known wave shape in the mud at the point of sensor 48, this pressure variation will be recorded on trace 58 of the record 59. The pressure variation will also travel downstream, through the mud column, as an elastic wave, of the same wave shape as the pressure variation. This elastic wave will travel through the mud column down through the drillstem and up the annulus to the surface past the second sensor 50. If the amplitude of this elastic wave has not been attenuated to zero, it will be detected by the second sensor 50 and will be recorded as trace 60 on record 59. Of course, by making the initial pressure variation of greater amplitude, there is more likelihood that there will be an amplitude of elastic wave signal passing the sensor 50 large enough to be detected and recorded on the chart 59.

Figure 2:
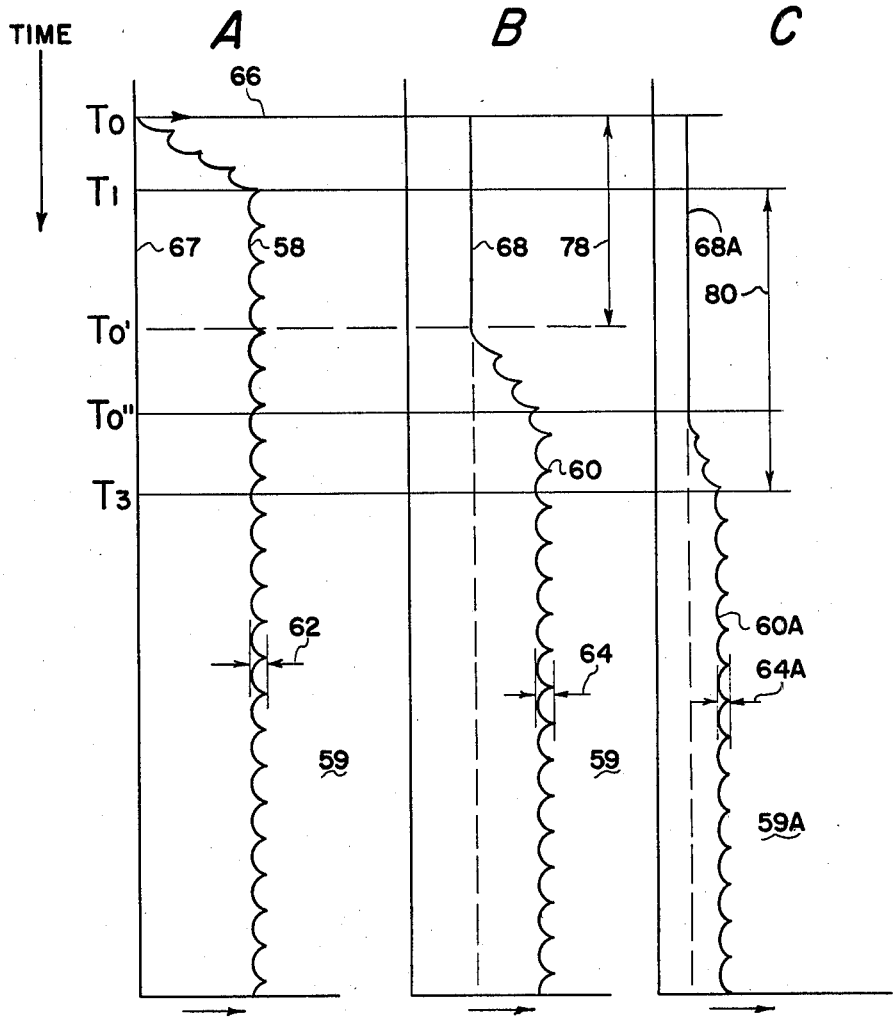
FIG. 2 represents sample pressure record traces taken at the well, from which appropriate interpretations can be made.

One of the important pressure variations that occurs naturally in the use of the conventional mud pumps comprises a pressure record like the trace 58 illustrated in FIG. 2. This is a record which shows the amplitude of pressure at the sensor 48, as a function of time, down the chart. In other words, at time T0 at the top, the mud pump is started, and the pressure of mud in the standpipe will increase according to the trace 58. At a selected short time later there will be such an amplitude as will thereafter remain substantially constant. This occurs at time T1. Even though the average value of the pressure on trace 58 remains constant from T1 to a later time, there is a minor variation in amplitude indicated by the numeral 62, which is the result of the action of the mud pump itself. The mud pumps are normally built with a plurality, such as three, for example, pistons and cylinders, which consecutively introduce volumes of liquid into the outlet pipe. The pressure variations of amplitude 62 will be normally occurring on most equipment and will be of sufficient amplitude to be recorded on the chart trace 58 by the pressure sensor 48.

The chart trace 60, indicated in part B of FIG. 2, is recorded by sensor 50. The chart trace 60 will, of course, start at some later time T0', which accounts for the travel of the elastic wave down through the mud in the drill pipe and up through the mud in the annulus to the second sensor 50, as previously mentioned. This is a function of the actual physical velocity of travel of the mud in the drill pipe and in the annulus. If there is no gas in the mud, and normally the mud is free of gas prior to injection into the standpipe 20, then the fluctuation in pressure on pressure trace 60 will be similar to that on trace 58. However, it will be of some smaller amplitude 64 which is caused by the normal attenuation of elastic waves in the water, or in the mud.

This time delay 78, between the start of pressure build-up at sensor 48 compared to the start of buildup of pressure in sensor 50 is a function of velocity of transmission of elastic waves in the mud, and also the actual velocity of transport of the mud. For a given size casing and drill pipe, and for constant speed of the mud pump drive, and other well-known factors, this time delay should be constant if the length of pipe is constant. Its change can be explained on the basis of a change of drilling depth or change of length of drill pipe in the hole if that has been the only thing that has happened.

Trace 60A in part C is a repetition of trace 60, taken some time after the bit has drilled into a gas formation, such as 32, at a selected depth 76 in the earth. Of course, there will be some gas released into the base of the borehole by the bit; however, this will be relatively small. On the other hand, if the bottomhole pressure of the mud is less than the gas pressure in the formation 32, gas will flow from the gas formation in accordance with arrows 34, into the mud, and up through the annulus, with the mud, in accordance with arrows 40.

The situation is now different, and if the amount of gas 34 is considerable, and a large portion of the length of the mud column in the annulus has been filled with gas, there will be considerable attenuation of the signal from sensor 50, as shown by trace 64A, due to the fact that the elastic wave has to pass up from the bottom of the hole, through the gas-containing mud. There will also be a lowered velocity of travel of the elastic wave, indicated by the greater delay time to T0″. This extra delay time of travel; that is, the delay between T0′ and T0″, or the increase of delay 80 over 78 is indication of a lower velocity of transmission through the upward traveling part of the path through the annulus. If all other factors are substantially constant this can only be due to a difference in the nature of the mud, which would be explained by the presence of gas.

Assume that the gas has only moved upward a short distance to the depth 72, for example, which may be, for example, one-tenth of the total path to the surface. The amount of time delay and attenuation that can take place is a function of this short length of mud column. Thus there will be less delay and attenuation than if the mud column containing gas has advanced up to the level 74, for example, which may be close to the top of the well. Consequently, by comparing the traces 60 and 60A the additional travel time delay, and the additional attenuation will be functions of the presence of gas, and of the length of time that the gas has had to travel upwardly in the annular column.

Thus, by repeating the pressure variation at the input to the drill pipe, at successive selected short time intervals, the delay from T0′ to T0″ should increase, as the gas has an opportunity to travel farther up the wall and thus this comparison of delay time will be a function of the progress of the gas column in the annulus. After the gas has had complete opportunity to travel to the surface, and there is a continual flow of gas into the base of the well, and a steady state condition has been established, there will be no further increase in time delay in the pressure record 59A. However, if the rate of gas flow into the well should increase, the attenuation per unit length of path, and the time delay would increase also, and this would be indicative of the additional gas flow rate.

If the normal pressure variations of amplitude 62 on the input end of the drill string are not sufficiently great to carry through and still maintain a measurable amplitude on the trace 60, then some larger pressure impulse is needed as an input to the signal transmission path. Thus some other procedure such as by a valve 70 connected with standpipe 20 may be used. Valve 70, when opened, reduces the mud pressure in standpipe 20, and this pressure reduction travels the length of the mud column and is subsequently detected by detector 50. Valve 70 may be connected by piping (not shown) to mud tank 18. Valve 70 can be opened and closed by manual or mechanical means which controls the pressure over a wide enough range, so that the elastic wave which is transmitted is recorded on the sensor 48 and then later on the sensor 50. Such a source of pressure signal can be utilized in addition to, or in place of, the naturally occurring variations in pressure in the pump output, as previously described.

It is clear that the pressure variation, or pressure signal, can be some time-pattern of pulses, which is unique, and therefore, can be detected in the pressure signal at sensor 50 by such well-known processes as correlation, and so on. In this way, a more precise determination of the time delay can be made, as well as a precise measurement of attenuation of amplitude, and so on.

While I have described the system in terms of only a single pressure sensor at the input and the output of the travel path through the drill stem and annulus, it is possible, of course, to use a plurality of detectors arranged along the path of the uptraveling mud flow in the annulus and by well-known techniques for noise cancellation, and for beam formation, to arrive at a much better pressure signal in terms of signal-to-noise ratio, than would otherwise be possible. However, this is not an essential part of the invention and would only be utilized in the case where the attenuation was very great and it was necessary to provide noise cancellation techniques, which are today widely known in the art.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In a rotary drilling system comprising:

(a) a borehole in the earth with a drill string of known length in said borehole, and means to rotate said drill string and bit;

(b) a mud pump, mud tank, and mud standpipe, to supply drilling mud under pressure to said drill string, to flow to said bit and up the annulus between said borehole and said string, to said mud tank, said mud pump adapted to produce a pulsating hydraulic pressure in said standpipe;

(c) at least a first pressure gauge or pressure sensor inserted into, to measure and record the mud pressure in, said standpipe;

(d) at least a second pressure gauge or pressure sensor inserted into, to measure and record the mud pressure in, the annulus of said borehole, near the surface of the earth;

the method of detecting the flow of gas from the wall of said borehole into the mud in said annulus, comprising the steps of;

(1) recording as a function of time, the hydraulic pressures detected by said first and second pressure sensors, as separate record traces, a first trace from said first pressure sensor, and a second trace from said second pressure sensor;

(2) starting the mud circulation through said drill string and said annulus;

(3) correlating said first trace with said second trace, in order to determine the first time of travel of the elastic wave in said mud from said first pressure sensor to said second pressure sensor; and (4) determining the first average time of travel per unit length of drill stem, of the elastic wave in said mud.

2. A method as in claim 1 including, after a selected time of drilling, the additional steps of;

(5) determining the new length of drill stem in said borehole;

(6) repeating steps (1), (2), (3), and (4) to determine a second time of travel of the elastic wave in said mud from said first pressure sensor to said second pressure sensor, and a second average time of travel per unit length of drill stem; and (7) comparing said first and second average time of travel per unit length of drill stem;

whereby if said second average time of travel is greater than said first average time of travel, indications are that gas is entering the mud in said annulus.

3. The method as in claim 2 including, after a relatively short selected time of circulation, the additional steps of;

(8) repeating steps (5) and (6);

(9) comparing the second and the third average time of travel per unit length of drill stem;

whereby if the third average time of travel per unit length of drill stem is greater than said second average time of travel per unit length of drill stem, indications are that the length of mud column in said annulus, which contains gas, is increasing.

4. In a rotary drilling system comprising:

(a) a borehole in the earth with a drill string of known length in said borehole, and means to rotate said drill string and bit;

(b) a mud pump, mud tank, and mud standpipe, to supply drilling mud under pressure to said drill string, to flow to said bit and up the annulus between said borehole and said string, to said mud tank; said mud pump adapted to produce a pulsating hydraulic pressure in said standpipe;

(c) at least a first pressure sensor inserted into said standpipe, to measure and record the mud pressure in said standpipe;

(d) at least a second pressure gauge or pressure sensor inserted into, to measure and record the mud pressure in, the annulus of said borehole, near the surface of the earth;

the method of detecting the flow of gas from the wall of said borehole into the mud in said annulus, comprising the step of;

(1) recording as a function of tinme, the hydraulic pressures detected by said first and second pressure sensors, as separate record traces, a first trace from said first pressure sensor and a second trace from said second pressure sensor, while the mud is circulating through said drill string and annulus;

(2) pulsing the mud pressure in said standpipe in a selected time sequence for a selected short period of time;

(3) correlating said first trace with said second trace, in order to determine the first time of travel of the elastic wave in said mud from said first pressure sensor to said second pressure sensor;

(4) determining the first average time of travel per unit length of drill stem, of the elastic wave in said mud.

5. The method as in claim 4 including, after a selected time of drilling, the additional steps of;

(5) determining the new length of drill stem in said borehole;

(6) repeating steps (1), (2), (3), and (4) to determine a second time of travel of the elastic wave in said mud from said first pressure sensor to said second pressure sensor; and a second average time of travel per unit length of drill stem; and (7) comparing said first and second average time of travel per unit length of drill stem;

whereby if said second average time of travel is greater than said first average time of travel, indications are that gas is entering the mud in said annulus.

6. The method as in claim 5 including, after a relatively short selected time of circulation, the additional steps of:

(8) repeating steps (5) and (6);

(9) comparing the second and the third average time of travel per unit length of drill stem;

whereby if the third average time of travel per unit length of drill stem is greater than said second average time of travel per unit length of drill stem, indications are that the length of mud column in said annulus, which contains gas, is increasing.

7. In a rotary drilling system comprising:

(a) a borehole in the earth with a drill string of known length in said borehole, and means to rotate said drill string and bit;

(b) a mud pump, mud tank, and mud standpipe, to supply drilling mud under pressure to said drill string, to flow to said bit and up the annulus between said borehole and said string, to said mud tank; said mud pump adapted to produce a pulsating hydraulic pressure in said standpipe;

(c) at least a first pressure gauge or pressure sensor inserted into, to measure and record the mud pressure in, said standpipe;

(d) at least a second pressure gauge or pressure sensor inserted into, to measure and record the mud pressure in, the annulus of said borehole, near the surface of the earth;

the method of detecting the flow of gas from the wall of said borehole into the mud in said annulus, comprising the steps of:

(1) recording as a function of time, the hydraulic pressures detected by said first and second pressure sensors, as separate record traces, a first trace from said first pressure sensor, and a second trace from said second pressure sensor, while the mud is circulating through said drill string and annulus;

(2) creating at least a first pressure disturbance in said standpipe;

(3) comparing said first and second traces to identify said at least one pressure disturbance on both traces; and (4) determining the first ratio between the amplitude of said first trace and the amplitude of the second trace of said at least first pressure disturbance.

8. The method as in claim 7 including, after a selected time of drilling, the additional steps of:

(5) repeating steps (1), (2), (3) and (4) to determine a second ratio between the amplitude of said first trace and the amplitude of said second trace;

(6) comparing said first and second ratios between the amplitude of said first trace and the amplitude of said second trace;

whereby if said second ratio is greater than said first ratio, indications are that gas is entering the mud in said annulus.

9. The method as in claim 8 including, after a relatively short selected time of circulation, the addition steps of:

(7) repeating steps (5) and (6) to provide a third ratio;

(8) comparing said second and said third ratio;

whereby if said third ratio is greater than said second ratio, indications are that the length of mud column in said annulus, which contains gas, is increasing.

10. In a rotary drilling system having:

(a) a borehole in the earth with a drill string of known length in said borehole, and means to rotate said drill string and bit;

(b) a mud pump, mud tank, and mud standpipe, to supply drilling mud under pressure to said drill string, to flow to said bit and up the annulus between said borehole and said string, to said mud tank, said mud pump adapted to produce a pulsating hydraulic pressure in said standpipe;

(c) a first pressure sensor connected to measure and record the mud pressure in said standpipe;

(d) a second pressure sensor connected to measure and record the mud pressure in the annulus of said borehole, near the surface of the earth;

the method of detecting the flow of gas from the wall of said borehole into the mud in said annulus, comprising the steps of:

(1) recording as a function of time, the hydraulic pressures detected by said first and second pessure sensors, as separate first and second traces;

(2) creating at least a first pressure disturbance in said standpipe;

(3) comparing said first and second traces to identify said at least one pressure disturbance on both traces; and (4) determining the first ratio between the amplitudes of said pulsating pressure on said first and said second traces following said at least first pressure disturbance.

* * * * *